US011933563B2

(12) United States Patent
Plebani et al.

(10) Patent No.: US 11,933,563 B2
(45) Date of Patent: Mar. 19, 2024

(54) RIFLE WITH SAFETY GROUP

(71) Applicant: FABBRICA D'ARMI PIETRO BERETTA S.P.A., Brescia (IT)

(72) Inventors: Ennio Plebani, Brescia (IT); Calogero Spoto, Brescia (IT)

(73) Assignee: FABBRICA D'ARMI PIETRO BERETTA S.P.A., Brescia (IT)

( * ) Notice: Subject to any disclaimer, the term of this patent is extended or adjusted under 35 U.S.C. 154(b) by 0 days.

(21) Appl. No.: 17/968,226

(22) Filed: Oct. 18, 2022

(65) Prior Publication Data

US 2023/0117711 A1 Apr. 20, 2023

(30) Foreign Application Priority Data

Oct. 18, 2021 (IT) ..... 102021000026648

(51) Int. Cl.
*F41A 17/74* (2006.01)
*F41A 3/20* (2006.01)

(52) U.S. Cl.
CPC ..... *F41A 17/74* (2013.01); *F41A 3/20* (2013.01)

(58) Field of Classification Search
CPC ..... F41A 17/52; F41A 17/62; F41A 17/70; F41A 17/80
USPC ..... 42/70, 70.05, 70.06, 70.08
See application file for complete search history.

(56) References Cited

U.S. PATENT DOCUMENTS 1,108,400 A * 8/1914 Savage ..... F41A 9/18 42/21
1,704,889 A 3/1929 Gardiner
3,234,679 A * 2/1966 Benson ..... F41A 3/68 42/16
3,949,508 A * 4/1976 Elkas ..... F41A 17/62 42/70.08
4,024,664 A * 5/1977 Murabito ..... F41A 17/80 42/70.08

(Continued)

FOREIGN PATENT DOCUMENTS

DE 10 2018 114 381 A1 12/2019
EP 3 869 142 A1 8/2021

OTHER PUBLICATIONS

Italian Search Report for Italian Patent Application No. 102021000026648 dated May 26, 2022, 2 pages.

*Primary Examiner* — Bret Hayes
(74) *Attorney, Agent, or Firm* — Merchant & Gould P.C.

(57) ABSTRACT

A rifle has a fixed main body, including a barrel, a receiver with an upper opening, and a breech element. A trigger group is at least partially housed in the receiver, including a trigger, a hammer device operable by the trigger, and a safety member positionable in a shooting position, disengaged from the hammer device and in a safety position, engaged with and blocking the hammer device. A carriage assembly with a shutter group is positioned on the receiver at the upper opening and axially movable by the user between an advanced shooting configuration and a retracted rearming configuration. The carriage assembly includes a safety group controllable by the user, with the carriage assembly in the advanced configuration, in a ready-to-shoot configuration, in which it is disengaged from the safety member, and a safety configuration, in which it engages and keeps the safety member in the safety position.

15 Claims, 9 Drawing Sheets

(56) References Cited

U.S. PATENT DOCUMENTS

| | | | | |
|---|---|---|---|---|
| 2012/0159830 | A1* | 6/2012 | Ostanin | F41A 17/70<br>42/70.08 |
| 2015/0377575 | A1* | 12/2015 | Potter | F41A 11/00<br>42/69.01 |
| 2016/0047615 | A1* | 2/2016 | Tubb | F41A 17/56<br>42/69.01 |

* cited by examiner

RIFLE WITH SAFETY GROUP

CROSS-REFERENCE TO RELATED APPLICATION

This application claims the benefit of Ser. No. 102021000026648, filed 18 Oct. 2021 in Italy and which application is incorporated herein by reference. To the extent appropriate, a claim of priority is made to the above disclosed application.

BACKGROUND OF THE INVENTION

The present invention relates to a rifle

In particular, the present invention relates to a rifle preferably, but not necessarily, for hunting.

In still further detail, the rifle which is the object of the present invention is of the type in which the rearming operations are performed by the user by axially manually moving the carriage assembly.

In the prior art, rifles with the aforementioned features and operating modes are known.

In particular, embodiments of rifles are known which comprise a fixed main body which may be gripped by the user, and a carriage assembly which may be manually moved by the user to rearm the shot. In particular, in such rifles, the carriage assembly is known to move between an advanced configuration and a retracted configuration and vice versa. Preferably, such known rifle solutions comprise a rearming trigger, or rearming lever, which may be gripped by the user to carry out the aforesaid operations.

In particular, the known solutions of rifles of this type include solutions comprising a trigger group of the "striker fired" type. In other words, the actuation of the trigger involves an actuation of the striker whose kinetic inertia is due to the presence of a preloaded spring. [MN] Furthermore, rifle solutions are known which comprise a trigger group with a hammer device.

Both of the above solutions have advantages, but at the same time they have drawbacks.

In particular, both said types of rifles comprise carriage assemblies that feature reduced axial strokes, having complex interaction operations with the bullet to be shot and with the cartridge case of the exploded bullet.

SUMMARY OF THE INVENTION

The object of the present invention is to provide an alternative rifle solution to such known solutions of the prior art, having a hammer device but guaranteeing simple movements of the carriage assembly.

The rifle solution which is the object of the present invention has all the technical advantages linked to said type of trigger group with a hammer device and at the same time all the possible advantages from solutions in which large strokes of the carriage assembly are possible.

BRIEF DESCRIPTION OF THE DRAWINGS

In addition, further features and advantages of the invention will become clear from the description provided below of its preferred embodiments given as non-limiting examples in reference to the attached figures, wherein:

FIG. 1*a*' and 1*b*' show side views of the rifle shown in FIGS. 1A and 1*b;*

DETAILED DESCRIPTION OF THE PREFERRED EMBODIMENT

Figures 1A, 1B:
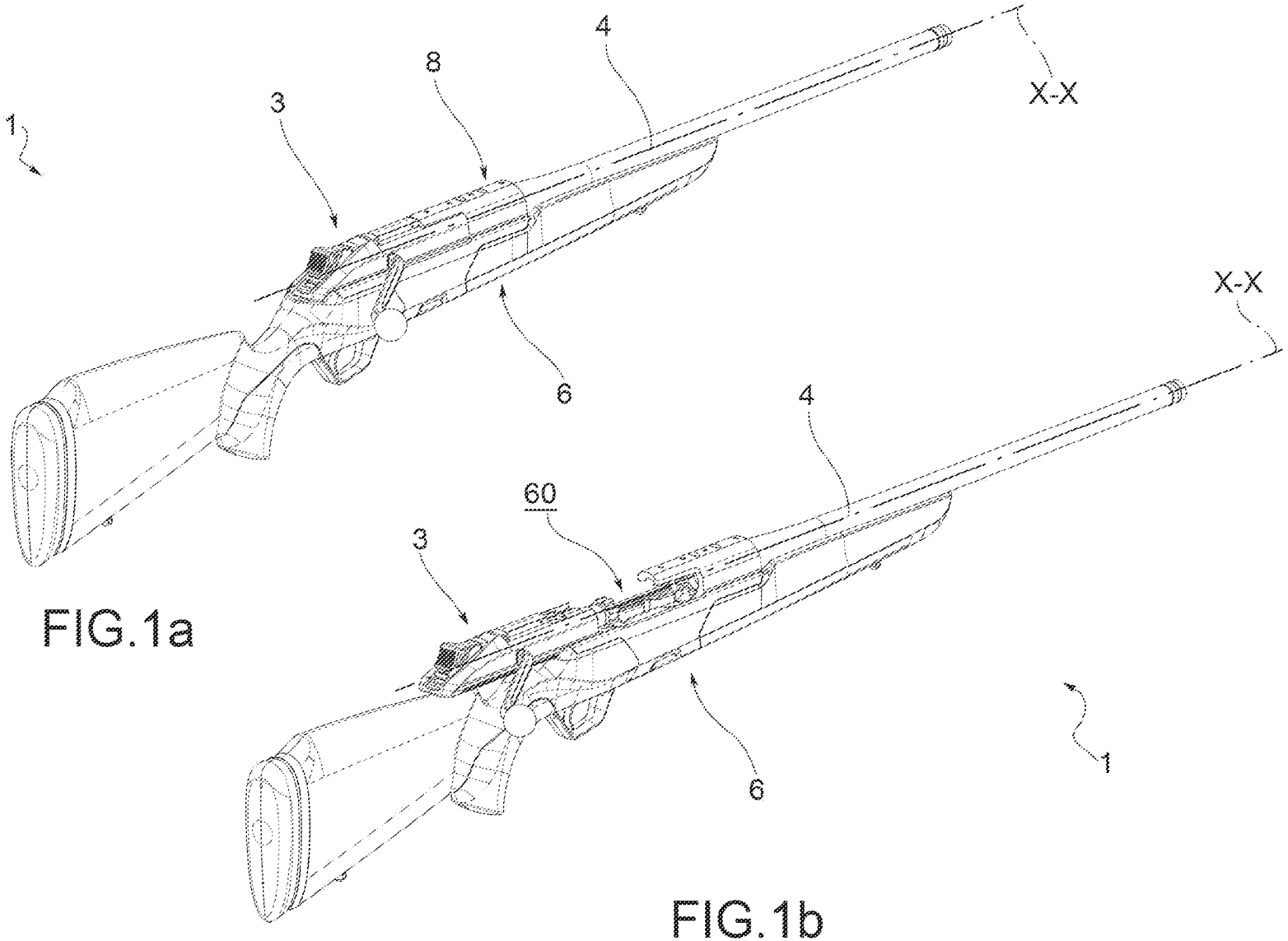
FIGS. 1*a* and 1*b* are perspective views of a rifle according to the present invention, in which the carriage assembly included therein, according to a preferred embodiment, is in an advanced shooting configuration and in a retracted rearming configuration.
Figure 1A:
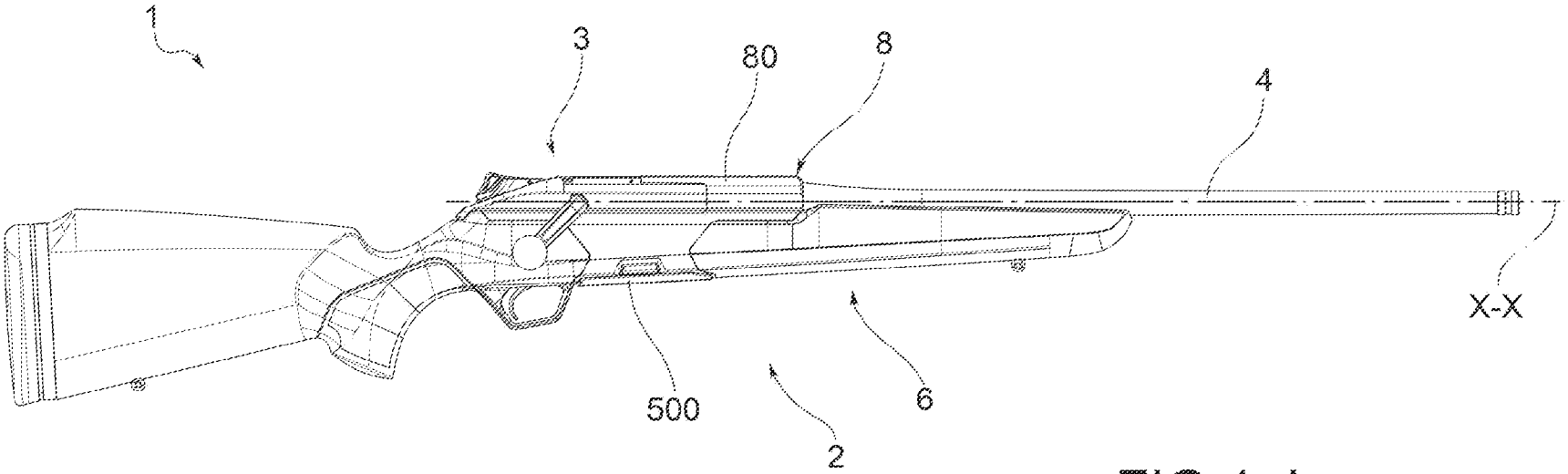
Figure 1B:
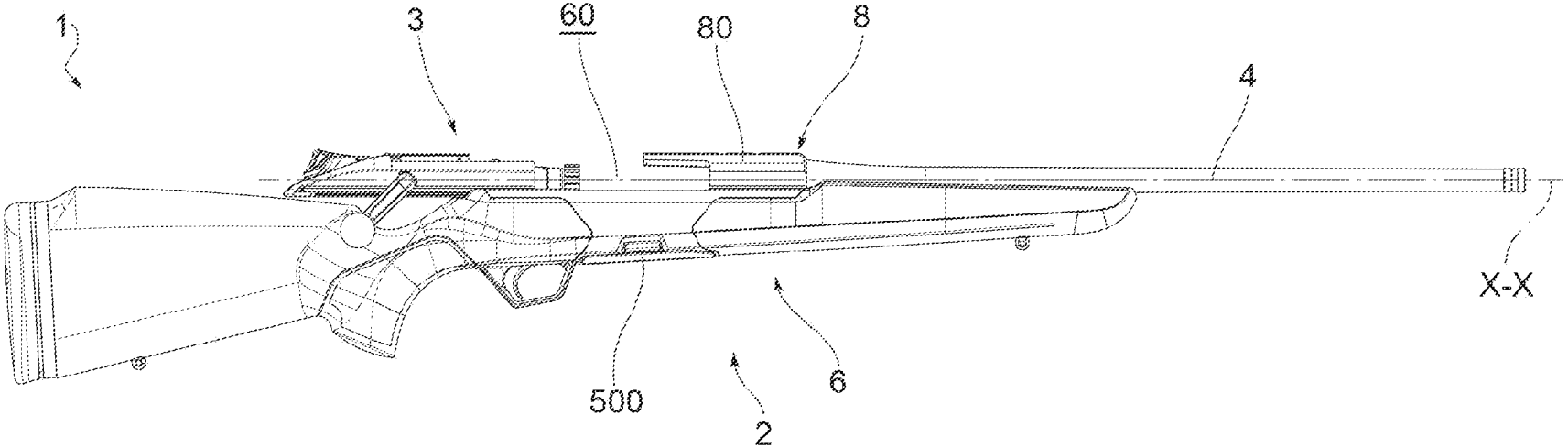
Figure 2:
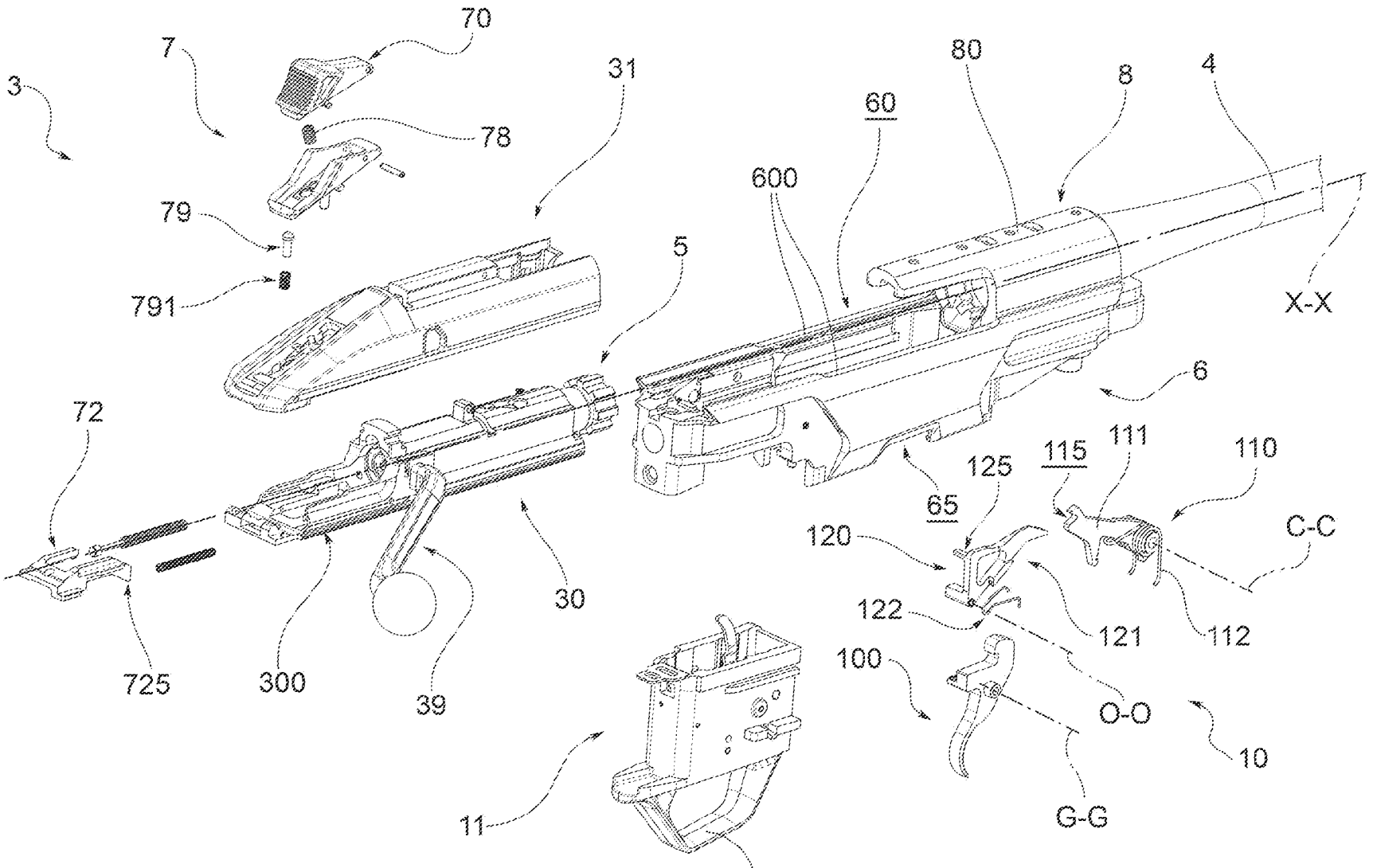
FIG. 2 is a perspective view with separate parts of some components included in the rifle of FIGS. 1*a* and 1*b;*
Figure 3:
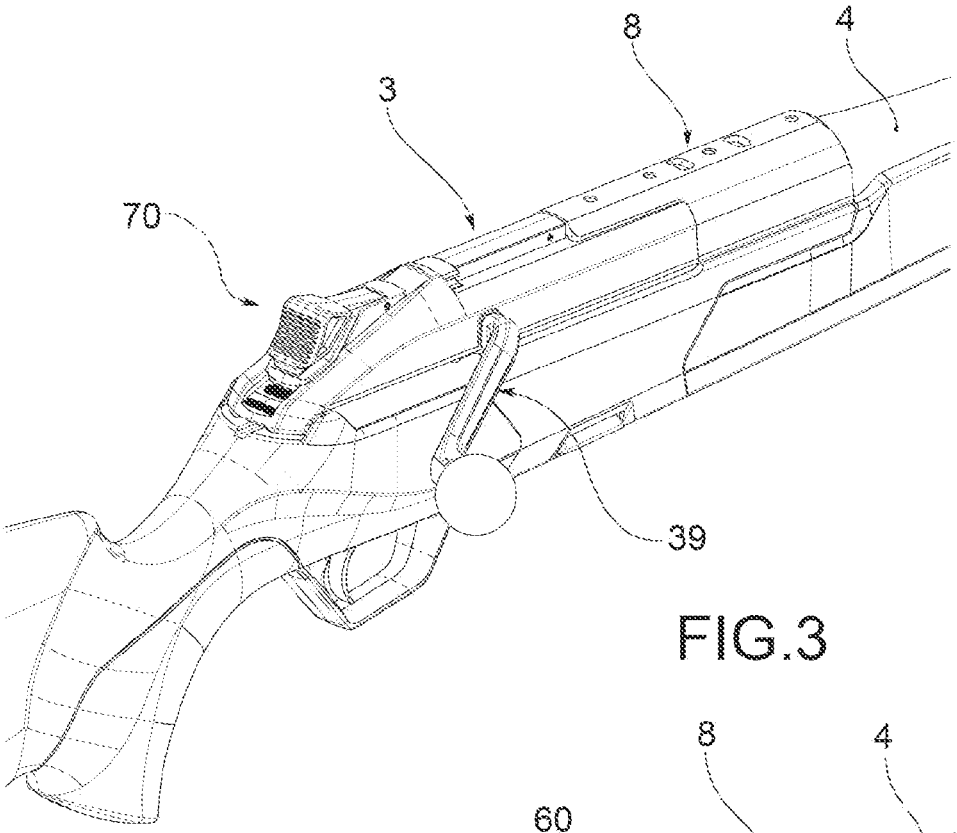
FIGS. 3 and 3' show two partial perspective views of the rifle in the ready-to-shoot configuration, in which the carriage assembly is in an advanced configuration and in a retracted configuration, respectively.
Figure 3:
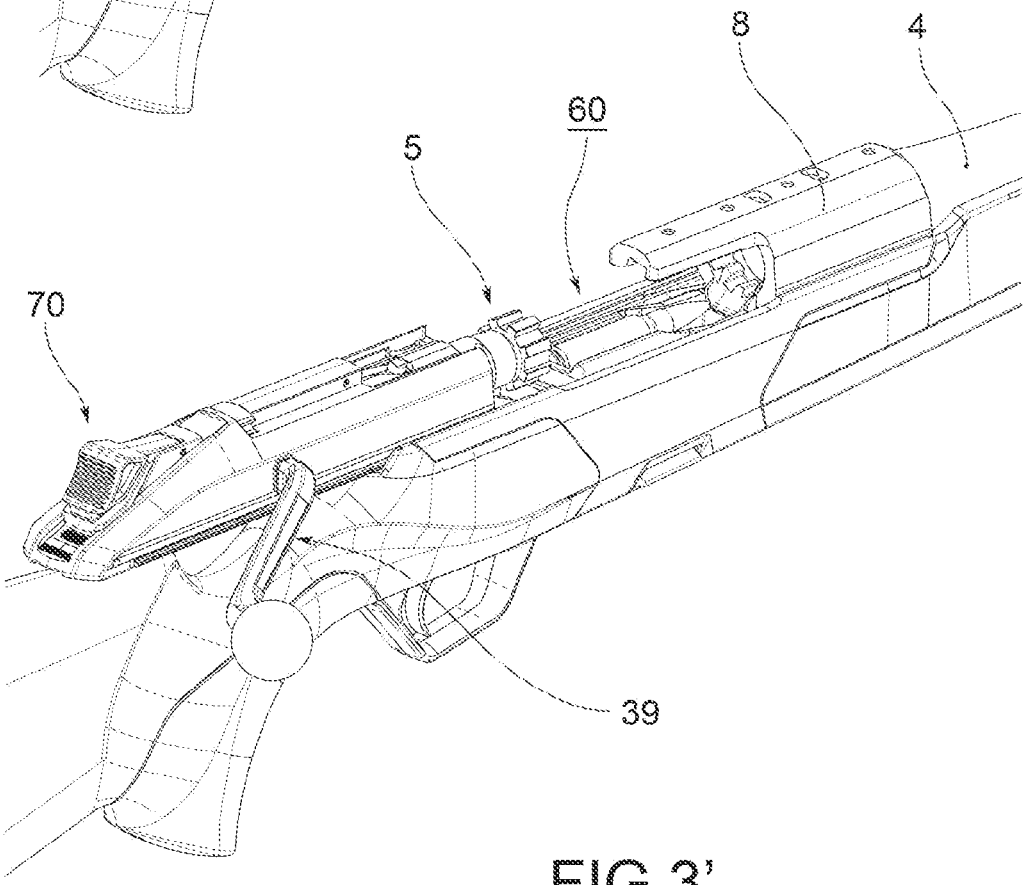
Figure 3A:
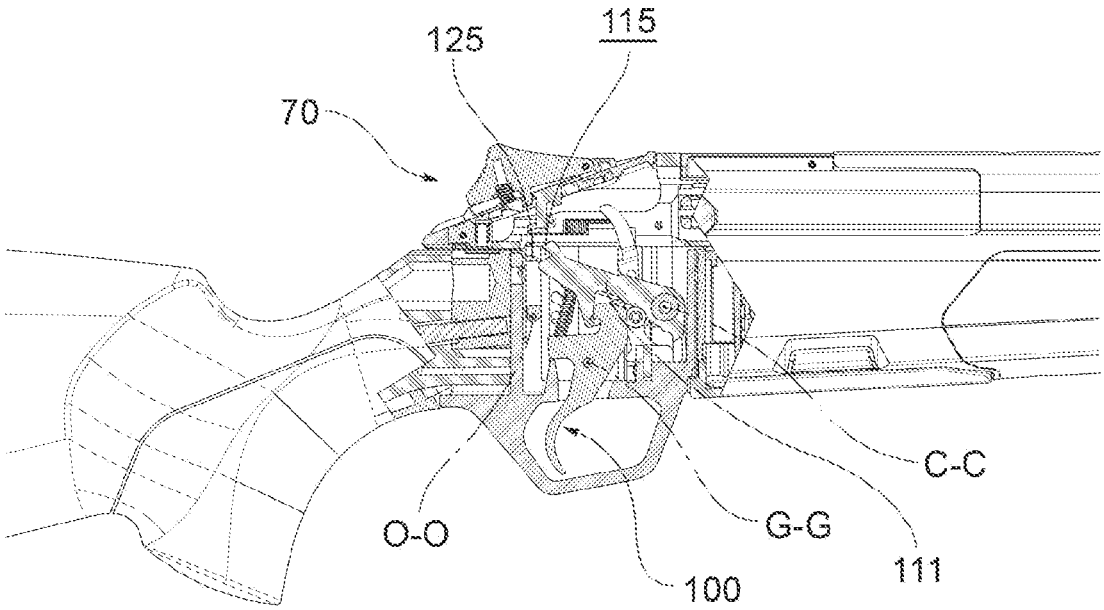
FIGS. 3*a* and 3*b* show two longitudinal sectional views, along a first imaginary plane and along a second imaginary plane, respectively, of the rifle in a ready-to-shoot configuration.
Figure 3B:
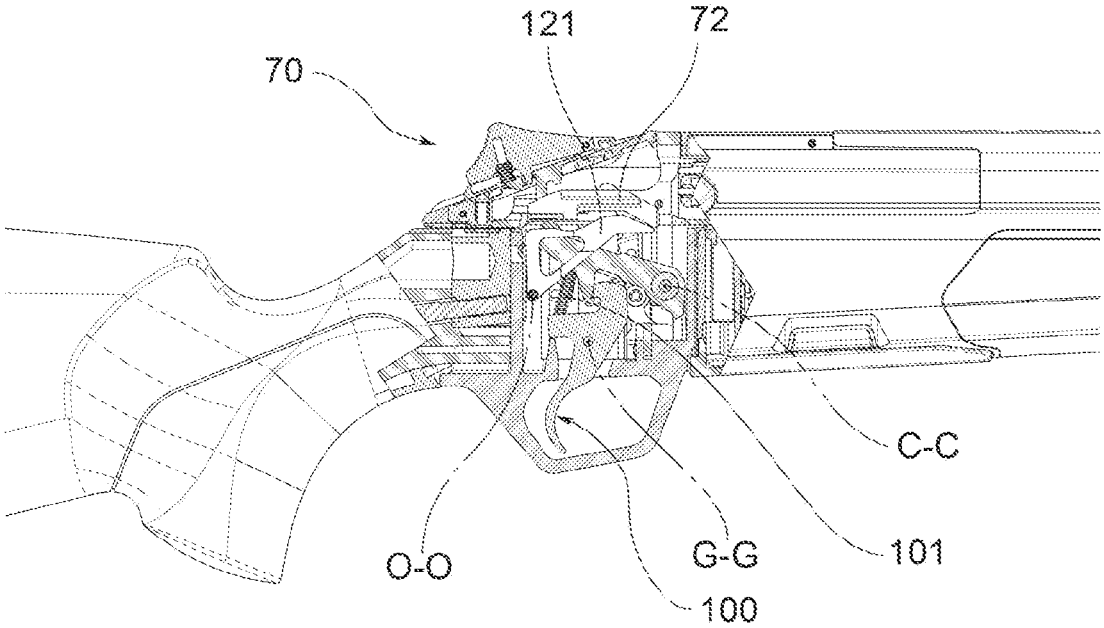
Figure 4:
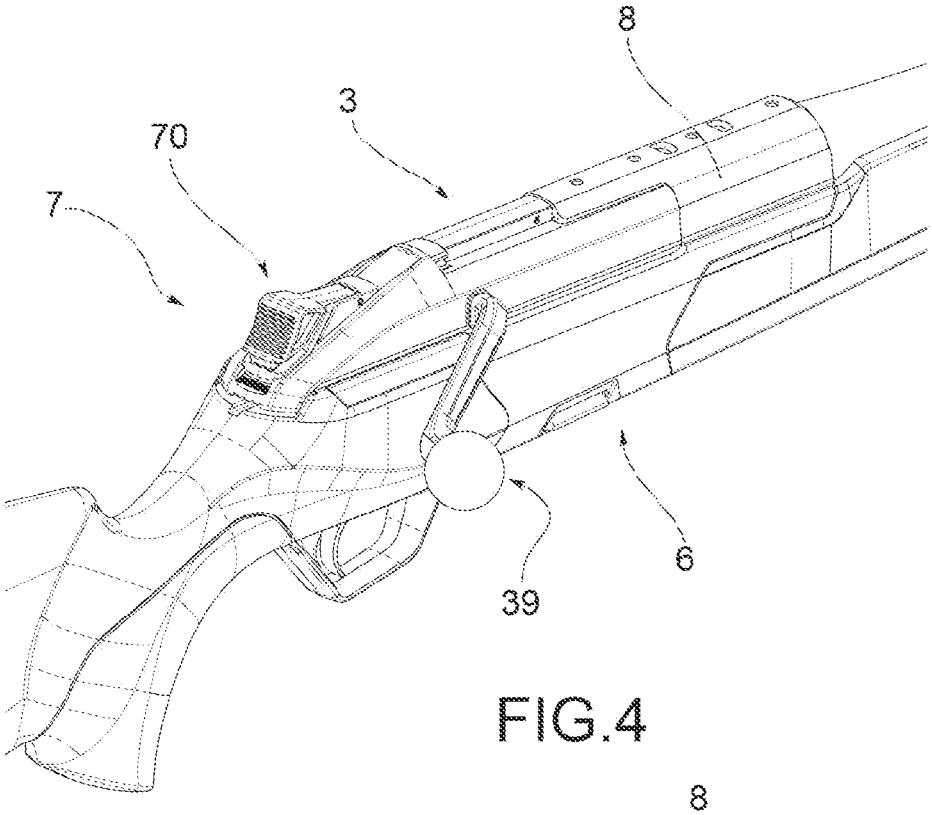
FIGS. 4 and 4' show two partial perspective views of the rifle in the safety configuration, in which the carriage assembly is in an advanced configuration and in a retracted configuration, respectively.
Figure 4:
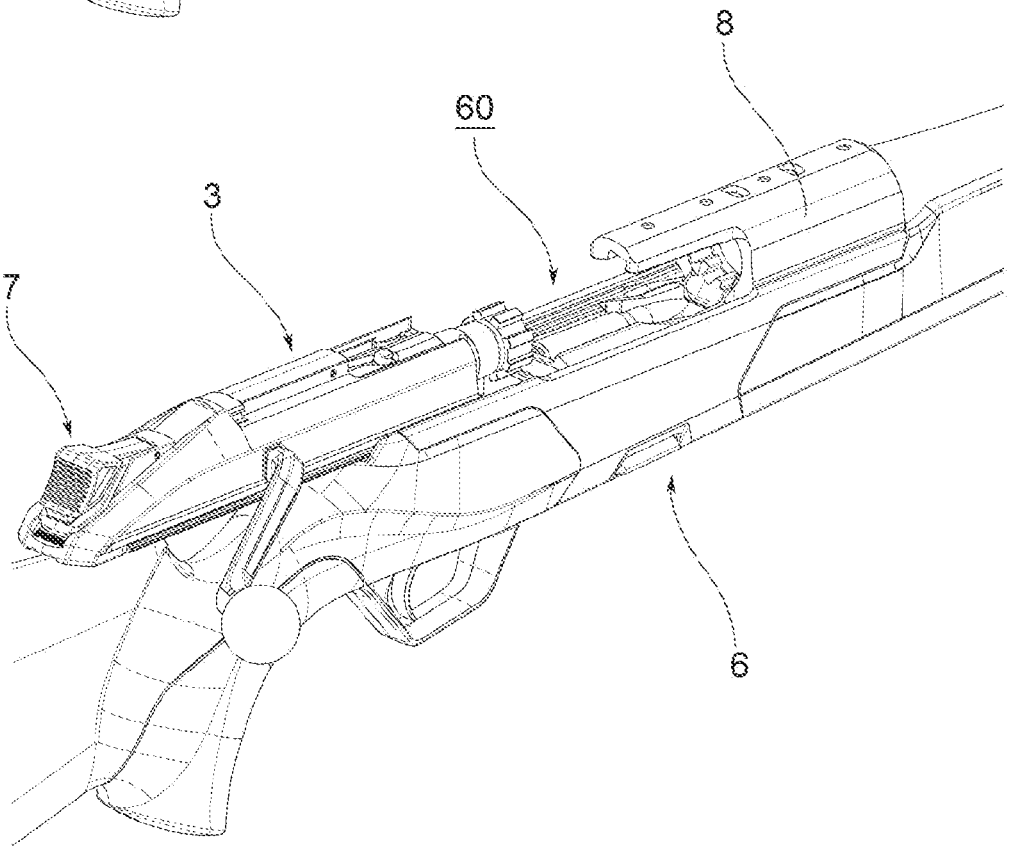
Figure 4A:
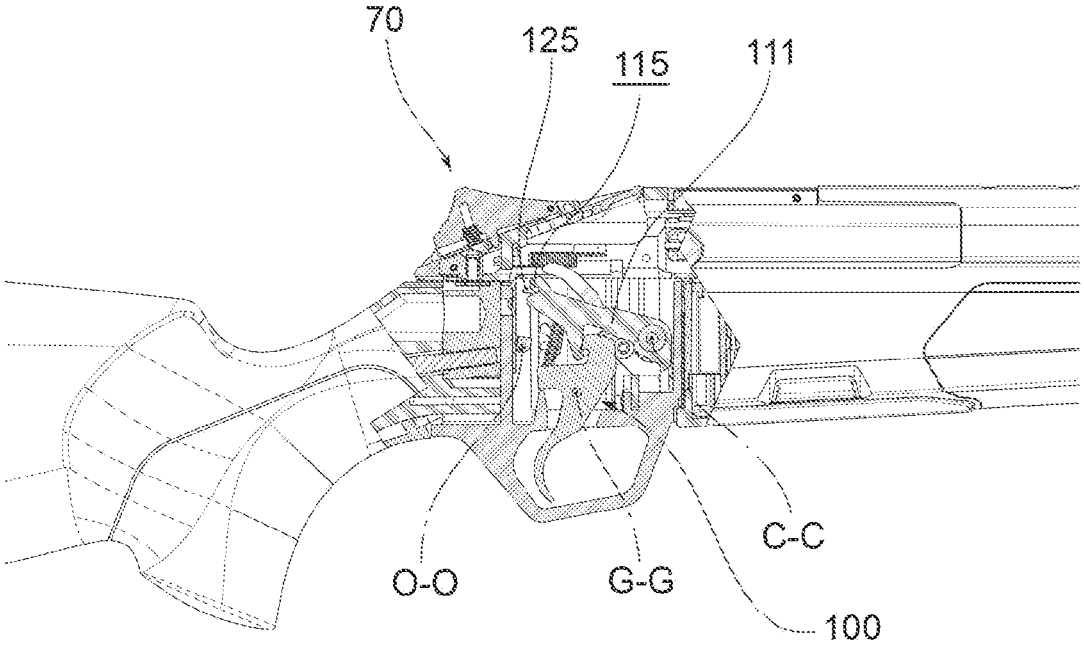
FIGS. 4*a* and 4*b* show two longitudinal sectional views, along a first imaginary plane and along a second imaginary plane, respectively, of the rifle in a safety configuration.
Figure 4B:
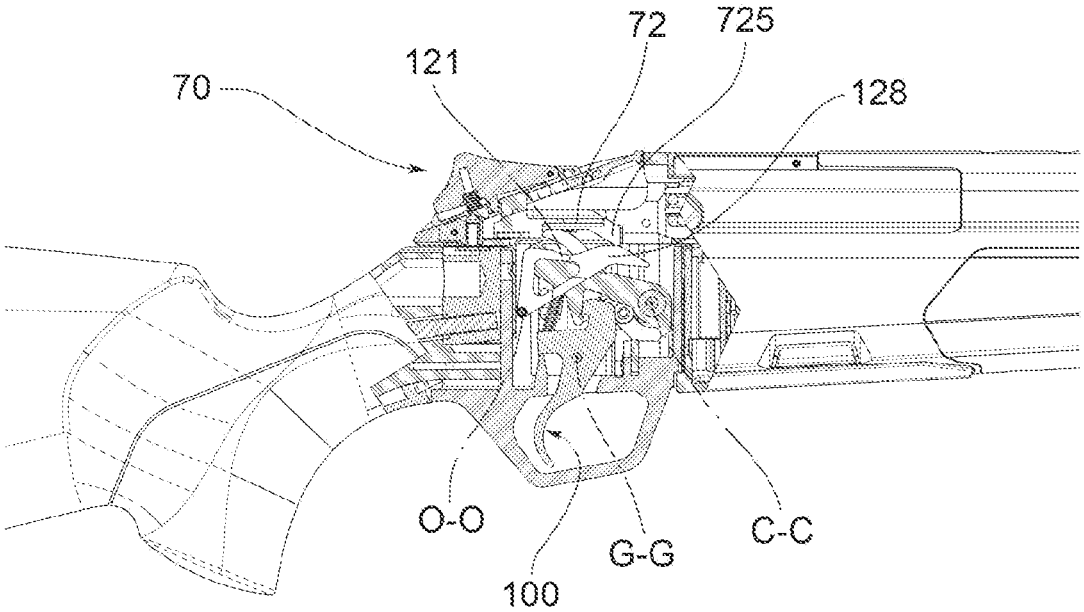
Figure 5:
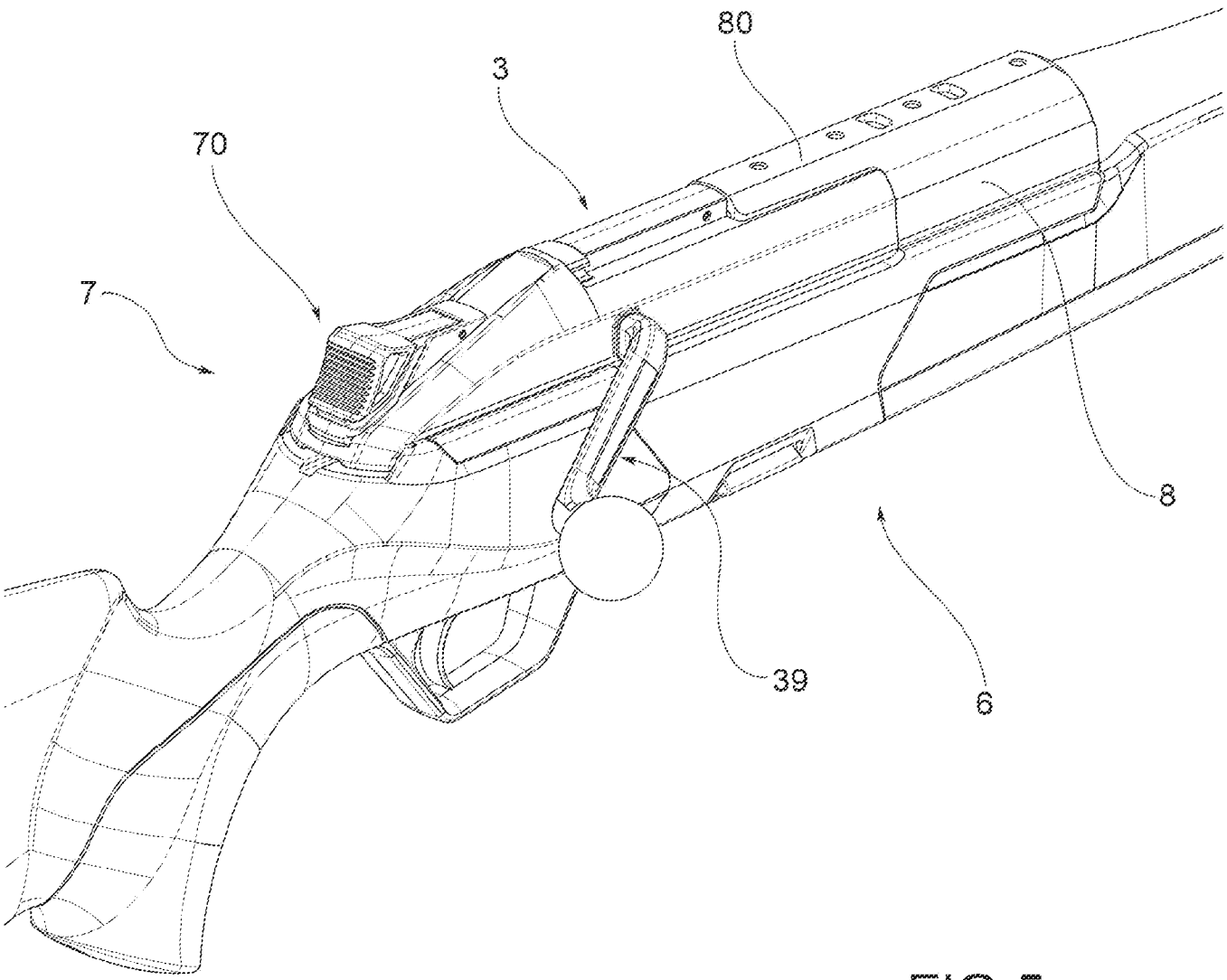
FIG. 5 shows a partial perspective view of the rifle in the blocking configuration, in which the carriage assembly is blocked in the advanced configuration.
Figure 5A:
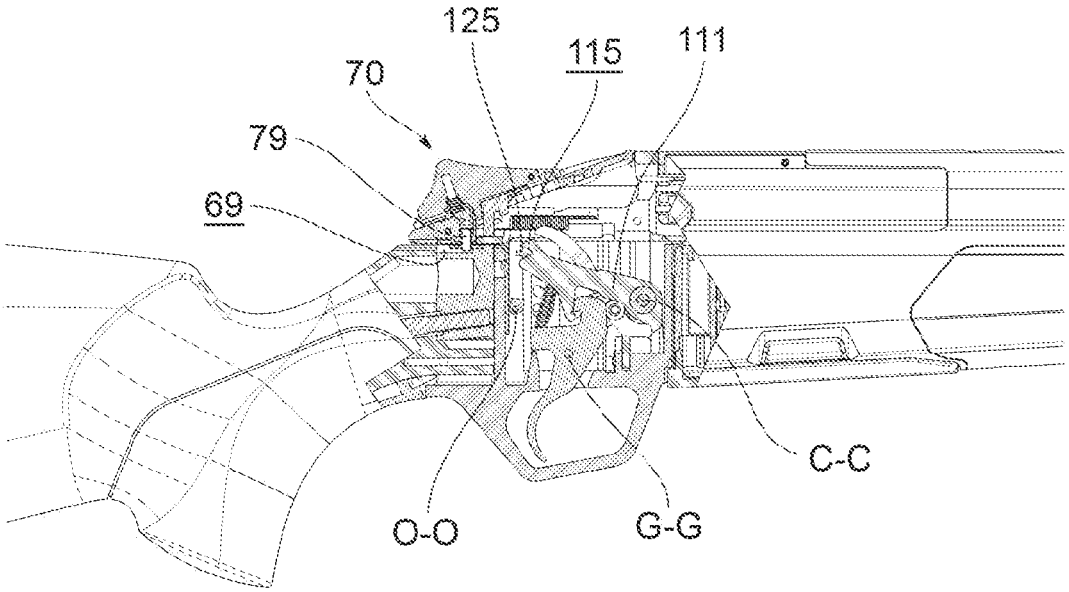
FIGS. 5*a* and 5*b* show two longitudinal sectional views, along a first imaginary plane and along a second imaginary plane, respectively, of the rifle in a blocking configuration.
Figure 5B:
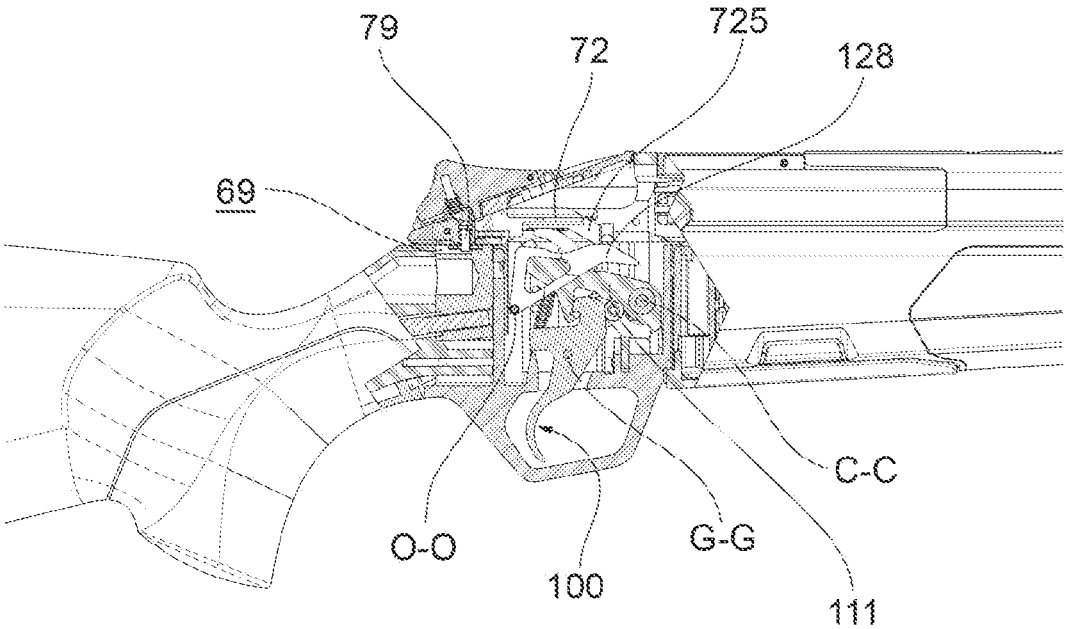

With reference to the accompanying figures, a rifle according to this invention is indicated with the numeral 1 in its entirety.

The rifle 1 which is the object of the present invention comprises a plurality of components which by convention are defined as fixed, and a plurality of components which are defined as movable.

According to the present invention, the rifle 1 comprises a fixed main body 2.

This main body 2 is grippable or embraceable by the user, for example in shooting or aiming operations, comprising a stock and/or forend.

According to the present invention, the fixed body 2 comprises a barrel 4 which extends along an axis X-X. The axis X-X is therefore the barrel axis.

Preferably, with reference to movements or certain characteristics or components, "axial" refers to movements or characteristics or components which occur or which are positioned parallel to said axis X-X, i.e. parallel to the barrel 4. In some cases, such movements or characteristics or components are along the barrel axis X-X. Alternatively to the term "axial", the term "longitudinal" is also used.

According to the present invention, the main body 2 comprises a receiver 6.

Preferably, the receiver 6 is made of a material belonging to the family of metals or metal alloys, or polymers, or polymeric materials, or composite materials.

According to the present invention, the receiver 6 has an upper opening 60.

In other words, the receiver 6 has an opening 60 facing the vertical direction.

In still other words, the receiver 6 is a receiver "without a castle".

The receiver 6 is a hollow component suitable for containing components, shooting mechanisms, and bullets. Preferably, the barrel 4 extends from the receiver 6.

Preferably, the stock extends from the receiver 6.

Preferably, the forend extends from the receiver 6.

Preferably, the receiver 6 also comprises a lower opening 65. The bullets enter through said lower opening 65. Preferably, a loader 500 is housed in the receiver 6. Preferably, the loader 500 is inserted through said lower opening 65. Preferably, the loader 500 closes said lower opening 65.

According to a preferred embodiment, the main body 2 also comprises a breech element 8 positioned at an axial end of said upper opening 60.

According to a preferred embodiment, the breech element 8 extends in height, preferably in a vertical direction.

Preferably, the barrel 4 is mountable to the breech element 8 at an opposite end from the firing mouth of the barrel 4.

According to a preferred embodiment, the breech element 8 is included in the barrel 4: the breech element 8 is the axial end opposite the firing mouth of the barrel 4.

According to a preferred embodiment, the aforementioned components, listed in a non-limiting manner, that form part of the main body 2 are all mutually distinct components.

According to an embodiment variant, the aforementioned components, listed in a non-limiting manner, that form part of the main body 2 are sometimes mutually integral: some components are mutually integrally connected to each other.

According to the present invention, the rifle 2 comprises a trigger group 10 operable by the user to carry out the shooting action.

The trigger group 10 is at least partially housed in the receiver 6.

Said trigger group 10 comprises a trigger 100.

Preferably, said trigger 100 is rotationally movable about a trigger axis G-G. Preferably, the trigger axis G-G has a substantially transverse extension.

Said trigger group comprises a trigger spring 101 which acts on the trigger 100.

Preferably, said trigger spring 101 is an axial spring.

The trigger group 10 further comprises a hammer device 110 operable by the trigger 100.

According to a preferred embodiment, the hammer device 110 comprises a hammer lever 111 which is rotationally movable about a hammer axis C-C. Preferably, the hammer axis C-C has a substantially transverse extension.

Furthermore, preferably, the hammer device 110 comprises a hammer spring 112 which engages the hammer lever 111 and executes a loading action thereon.

Preferably, said hammer spring 112 is a torsion spring.

According to a preferred embodiment, the trigger group 10 further comprises a safety member 120 positionable in a shooting position, in which it is disengaged from the hammer device 110 which is free to move, and in a safety position, in which it engages the hammer device 110, blocking it.

In other words, the positioning of the safety member 120 allows or inhibits the movement of the hammer device 110, in particular the movement of the hammer lever 111.

According to a preferred embodiment, by blocking the movement of the hammer device 110, the shot is blocked: in a preferred embodiment, by blocking the hammer device 110, the trigger 100 is also blocked; in a preferred embodiment, by locking the hammer device 110, the trigger 100 is movable when unloaded.

According to a preferred embodiment, the safety member 120 comprises a member lever 121 rotationally movable about a member axis O-O. Preferably, the member axis O-O has a substantially transverse extension.

Furthermore, preferably, the safety member 120 comprises a member spring 122 which engages the safety lever 121 and executes a loading action thereon.

Preferably, the member spring 122 is a torsion spring.

According to a preferred embodiment, the hammer lever 111 and the member lever 121 are positioned transversely, next to each other, preferably extending axially substantially parallel to each other.

In other words, according to a preferred embodiment, the hammer lever 111 and the member lever 121 lie substantially on two different imaginary planes which are mutually substantially parallel, preferably substantially parallel to the axis X-X.

According to a preferred embodiment, the hammer lever 111 and the member lever 121 have respective portions suitable for interacting. In particular, the interaction between the hammer lever 111 and the member lever 121 prevents the movement of the hammer lever 111.

According to a preferred embodiment, the hammer lever 111 comprises a cavity 115 and the member lever 121 comprises a transverse projection 125.

Preferably, in the safety position, the transverse projection 125 houses in the cavity 115 preventing the hammer lever 111 from moving.

According to a preferred embodiment, the transverse projection 125, when housed in the cavity 115, also executes a thrust action on the hammer lever 111.

Preferably, by executing the aforementioned thrust action on the hammer lever 111, further movement thereof is prevented, and at the same time it is disengaged from the trigger 100. For this reason, any pressure on the trigger 100 does not involve any modification of the position of the hammer lever 111.

According to a preferred embodiment, the trigger group 10 comprises a trigger box 11 which is removably, at least partially, housable in the receiver 6. Said trigger box 11 at least partially houses the aforesaid hammer device 110 and safety device 120. Preferably, the described levers are rotationally engaged to the walls of the trigger box 11.

According to a preferred embodiment, the trigger box 11 is hollow and open at the top and at the bottom. The trigger 100 projects below. Preferably, the trigger box 11 comprises the hand guard 118.

According to a preferred embodiment, the trigger box 11 is insertable into the receiver 6 through said lower opening 65.

Preferably, the trigger box 11 is insertable into the receiver 6 with an insertion movement in the vertical direction and a subsequent axial movement.

According to a preferred embodiment, the receiver 6 comprises trigger box sliding rails and, vice versa, the trigger box comprises protruding elements suitable for sliding on the sliding rails. Preferably, said sliding rails have a substantially axial extension.

According to the present invention, the rifle 1 comprises a carriage assembly 3 comprising a shutter group 5.

According to a preferred embodiment, the shutter group 5 also comprises striker members which may be engaged by the actuated hammer device 110.

More generally, the carriage assembly 3 comprises components, the movements and actuations of which involve a shooting action and a rearming action, i.e. discharging the exploded cartridge case to the outside and loading the bullet from the loader 500.

According to the present invention, the carriage assembly 3 is positioned on the receiver 6 at the upper opening 60.

According to a preferred embodiment, the carriage assembly 3 is positioned and has a shape suitable for closing said upper opening 60.

Preferably, the carriage assembly 3 slides on the axial edges 600 delimiting the upper opening.

According to a preferred embodiment, the carriage assembly 3 comprises an assembly body 30 comprising dedicated guides 300 suitable for sliding on said axial edges 600.

Preferably, the carriage assembly 3 comprises a body cover 31 mountable to the assembly body 30.

According to the present invention, the carriage assembly 3 is axially movable by the user between an advanced shooting configuration and a retracted rearming configuration, and vice versa.

Preferably, the carriage assembly 3 comprises a rearming handle 39, or rearming trigger, or rearming lever, which may be gripped by the user to perform the aforesaid operations.

According to the present invention, in the advanced or shooting configuration, the shutter group 5 engages the breech element 8, completely closing the upper opening 60. In said advanced configuration, the rifle 1 is therefore ready to execute the shooting action, acting with the trigger group 10, in particular with the hammer device 110 engaging the shutter group 5, in particular the striker members.

According to the present invention, in the retracted rearming configuration, the carriage assembly 3 is positioned so that the upper opening 60 is open. This means that the upper opening 60 is accessible from the top. Preferably, the upper opening 60 is accessible both from the top and from the sides.

In the retracted configuration, the rifle 1 has discharged the cartridge case, and is ready to be brought back to the advanced shooting configuration. In said movement, the carriage assembly 3 is therefore suitable for reloading a bullet which may therefore be the object of the shooting action.

According to the present invention, the carriage assembly 3 further comprises a safety group 7 commandable by the user, with the carriage assembly 3 in a plurality of predefined configurations.

In particular, the safety group 7 is suitable for being operable with the carriage assembly 3 configured in the advanced configuration.

According to the present invention, the safety group 7 is configurable in a ready-to-shoot configuration, in which it is disengaged from the safety member 120, and a safety configuration, in which it engages and keeps the safety member 120 in the safety position.

Preferably, the safety group 7 is operatively connected to the safety member 120 to modify the position thereof. In the aforementioned configurations, the safety group 7 does not affect the possible axial movement of the entire carriage assembly 3.

According to a preferred embodiment, the safety group 7 is also configurable in a blocking configuration, in which it engages and keeps the safety member 120 in the safety position and in which it engages the receiver 6, preventing the movement of the carriage assembly 3, in such a way as to keep it in the advanced configuration. Preferably, the safety group 7 is directly operatively connected to the receiver 6. In the above configuration, the safety group 7 prevents any axial movement of the entire carriage assembly 3.

According to a preferred embodiment, the safety group 7 comprises a safety button 70 positionable by the user between a shooting position, a safety position and, optionally, a blocking position.

According to a preferred embodiment, the safety button 70 is positionable by linearly translating.

Preferably, the safety button 70 is positionable in one of the above two, or three, discrete positions.

Preferably, the safety button 70 is movable in a substantially axial direction. Preferably, the direction of movement of the safety button 70 is substantially parallel to the axial direction, inclined by a few degrees with respect to it.

A first position of the safety button 70 is therefore the highest and most axially advanced. This position corresponds to the ready-to-shoot configuration.

A second position of the safety button 70 is therefore not as high as the first and axially less advanced than the first. This position corresponds to the safety configuration.

A third position of the safety button 70 is the most lowered and the most axially retracted one. This position corresponds to the blocking configuration.

According to a preferred embodiment, the safety group 7 comprises an elastically yielding element 78 which acts on the safety button 70 in such a way as to keep it raised.

In this way, in order to move the safety button 70 linearly, the user must overcome the elastic action of said elastically yielding element 78.

According to a preferred embodiment, the safety button 70 is easily operable by the user, for example by engaging it with the thumb of the hand that grips the handle of the rifle 1 with which the trigger 100 is engage able.

According to a preferred embodiment, the safety group 7 comprises a safety lever 72 suitable for engaging the safety member 120.

Preferably, the change in the position of the safety button 70 corresponds to a change in the position of the safety lever 72 which in turn operates on the safety member 120.

According to a preferred embodiment, the safety lever 72 is moved by the safety button in an axial direction.

Preferably, the safety lever 72 is moved axially by the translation of the safety button 70.

Preferably, the safety lever 72 is positioned at the lower end of the carriage assembly 3, facing the upper opening 60 of the receiver 6.

According to a preferred embodiment, the safety lever 72 comprises a tooth 725 protruding at the bottom: in the ready-to-shoot configuration, said tooth 725 is disengaged from the safety member 120; in the safety configuration, said tooth 725 engages and keeps the safety member 120 in the safety position, in turn blocking the movement of the hammer device 110.

Preferably, said tooth 725 engages the safety member 120 also in the blocking configuration.

Preferably, the safety lever 72 and the safety member 120 are mutually specially shaped to facilitate mutual engagement and mutual disengagement.

According to a preferred embodiment, the tooth 725 is suitable for sliding on a member portion 128 of the safety member 120.

Preferably, both tooth 725 and member portion 128 comprise respective inclined or arched planes.

According to a preferred embodiment, with the safety lever 72 advanced and consequent disengagement of the tooth 725 from the safety member 120, the member spring 122 is suitable for keeping the member lever 121 raised, disengaging the safety member 120 from the hammer device 110.

According to a preferred embodiment, the safety group 7 comprises a pin 79 movable between a raised position and a lowered position, in which, in the blocking configuration, the safety button 70 engages said pin 79, positioning it in the lowered position, engaging it with the receiver 6 and preventing the movement of the carriage assembly 3 on the receiver 6.

Preferably, the pin 79 is kept raised by a spring 791. The safety button 70 in the retracted position presses said pin 79 which then, in a lowered position, engages the receiver 6, being housed in a relevant hole 69.

According to a preferred embodiment, specific accessories are mountable on the breech element 8, at the upper top 80 thereof, such as for example a targeting assembly.

Innovatively, the rifle which is the object of the present invention amply fulfills the intended purpose.

Advantageously, the rifle which is the object of the present invention is an alternative solution to the known ones.

Advantageously, the receiver has a wide and accessible upper opening. Advantageously, the carriage assembly in the retracted configuration allows wide access to the receiver.

Advantageously, the carriage assembly performs axial strokes greater than the axial strokes that occur in the solutions of the prior art.

Advantageously, the rifle which is the object of the present invention is suitable for carrying out shooting actions on bullets of different calibers.

Advantageously, the rifle which is the object of the present invention comprises a trigger group with a hammer device benefiting from all the technical advantages of this type of actuation.

Advantageously, the rifle provides specific components included in the carriage assembly and in the fixed body that are suitable for managing any dangerous situations.

Advantageously, the rifle provides the possibility of inhibiting the actuation of the hammer device by operating directly on the carriage assembly.

Advantageously, a simple actuation of the control button involves a change in the configuration of the state of the trigger group and/or of the entire carriage assembly.

Advantageously, the interaction between the various components and kinematic mechanisms is extremely simplified and does not involve difficulties or the risk of jamming, for example in rearming operations.

Advantageously, the cleaning operations of the rifle are extremely simplified.

Advantageously, the disassembly and assembly of the various components in the receiver is extremely simplified.

It is clear that a person skilled in the art may make changes to the invention described above in order to meet contingent needs, which changes all fall within the scope of protection as defined in the following claims.

The invention claimed is:

1. A rifle comprising:

i) a main body, comprising a barrel which extends along an axis, a receiver comprising an upper opening, a breech element positioned at an axial end of said upper opening;

ii) a trigger group at least partially housed in the receiver comprising a trigger, a hammer device operable by the trigger and a safety member positionable in a shooting position, in which the safety member is disengaged from the hammer device and in a safety position, in which the safety member engages the hammer device, blocking the hammer device;

iii) a carriage assembly comprising a shutter group, positioned on the receiver at the upper opening and movable by a user axially between an advanced shooting configuration, in which the shutter group engages the breech element and a retracted rearming configuration, in which the upper opening is open, and vice versa, wherein the carriage assembly further comprises a safety group controllable by the user, with the carriage assembly in the advanced configuration, in a ready-to-shoot configuration, in which the safety group is disengaged from the safety member, and a safety configuration, in which the safety group engages and keeps the safety member in the safety position, wherein the safety group is configurable in a blocking configuration, in which the safety group engages and keeps the safety member in the safety position and in which the safety group engages the receiver, preventing movement of the carriage assembly keeping the carriage assembly in the advanced configuration.

2. The rifle according to claim 1, wherein the safety group comprises a safety button positionable by the user between a shooting position, and a safety position.

3. The rifle according to claim 2, wherein the safety button is positionable by linearly translating.

4. The rifle according to claim 2, wherein the safety group comprises a safety lever configured for engaging the safety member, wherein, a change in the position of the safety button corresponds a change in position of the safety lever, which acts, in turn, on the safety member.

5. The rifle according to claim 4, wherein the safety lever is moved by the safety button in an axial direction.

6. The rifle according to claim 4, wherein the safety lever comprises a tooth protruding at a bottom of the safety lever, wherein, in the ready-to-shoot configuration, said tooth is disengaged from the safety member while in the safety configuration, said tooth engages and keeps the safety member in the safety position.

7. The rifle according to claim 1, wherein the hammer device comprises a hammer lever, which is rotationally movable about a hammer axis, extending substantially transversely, in which the safety member comprises a member lever, which is rotationally movable about a member axis, extending substantially transversely.

8. The rifle according to claim 7, wherein the hammer lever and the member lever are positioned transversely, next to each other.

9. The rifle according to claim 7, wherein the hammer lever and the member lever are positioned transversely, next to each other, extending axially substantially parallel to each other.

10. The rifle according to claim 1, wherein the trigger group comprises a trigger box which is removably, at least partially, housable in the receiver.

11. The rifle according to claim 10, wherein the receiver comprises a lower opening, wherein the rifle comprises a loader insertable into the lower opening, in which the trigger box is insertable into the receiver through said lower opening.

12. A rifle comprising:

i) a main body, comprising a barrel which extends along an axis, a receiver comprising an upper opening, a breech element positioned at an axial end of said upper opening;

ii) a trigger group at least partially housed in the receiver comprising a trigger, a hammer device operable by the trigger and a safety member positionable in a shooting position, in which the safety member is disengaged from the hammer device and in a safety position, in which the safety member engages the hammer device, blocking the hammer device;

iii) a carriage assembly comprising a shutter group, positioned on the receiver at the upper opening and movable by a user axially between an advanced shooting configuration, in which the shutter group engages the breech element and a retracted rearming configuration, in which the upper opening is open, and vice versa, wherein the carriage assembly further comprises a safety group controllable by the user, with the carriage assembly in the advanced configuration, in a ready-to-shoot configuration, in which the safety group is disengaged from the safety member, and a safety configuration, in which the safety group engages and keeps the safety member in the safety position;

wherein the safety group is configurable in a blocking configuration, in which the safety group engages and keeps the safety member in the safety position and in which the safety group engages the receiver, preventing movement of the carriage assembly keeping the carriage assembly in the advanced configuration, and wherein the safety group comprises a pin movable between a raised position and a lowered position, in which, in the blocking configuration, the safety button engages said pin, positioning said pin in the lowered position, engaging said pin with the receiver and preventing movement of the carriage assembly on the receiver.

13. A rifle comprising:

i) a main body, comprising a barrel which extends along an axis, a receiver comprising an upper opening, a breech element positioned at an axial end of said upper opening;

ii) a trigger group at least partially housed in the receiver comprising a trigger, a hammer device operable by the trigger and a safety member positionable in a shooting position, in which the safety member is disengaged from the hammer device and in a safety position, in which the safety member engages the hammer device, blocking the hammer device;

iii) a carriage assembly comprising a shutter group, positioned on the receiver at the upper opening and movable by a user axially between an advanced shooting configuration, in which the shutter group engages the breech element and a retracted rearming configuration, in which the upper opening is open, and vice versa, wherein the carriage assembly further comprises a safety group controllable by the user, with the carriage assembly in the advanced configuration, in a ready-to-shoot configuration, in which the safety group is disengaged from the safety member, and a safety configuration, in which the safety group engages and keeps the safety member in the safety position;

wherein the hammer device comprises a hammer spring, which engages the hammer lever and executes a loading action on the hammer lever, and the safety member comprises a member spring, which executes a thrust action on the member lever.

14. A rifle comprising:

i) a main body, comprising a barrel which extends along an axis, a receiver comprising an upper opening, a breech element positioned at an axial end of said upper opening;

ii) a trigger group at least partially housed in the receiver comprising a trigger, a hammer device operable by the trigger and a safety member positionable in a shooting position, in which the safety member is disengaged from the hammer device and in a safety position, in which the safety member engages the hammer device, blocking the hammer device;

iii) a carriage assembly comprising a shutter group, positioned on the receiver at the upper opening and movable by a user axially between an advanced shooting configuration, in which the shutter group engages the breech element and a retracted rearming configuration, in which the upper opening is open, and vice versa, wherein the carriage assembly further comprises a safety group controllable by the user, with the carriage assembly in the advanced configuration, in a ready-to-shoot configuration, in which the safety group is disengaged from the safety member, and a safety configuration, in which the safety group engages and keeps the safety member in the safety position;

wherein the hammer device comprises a hammer lever, which is rotationally movable about a hammer axis, extending substantially transversely, in which the safety member comprises a member lever, which is rotationally movable about a member axis, extending substantially transversely; and wherein the hammer lever comprises a cavity and the member lever comprises a transverse projection, in which, in the safety position, the transverse projection accommodates in the cavity preventing the hammer lever from moving.

15. A rifle comprising:

i) a main body, comprising a barrel which extends along an axis, a receiver comprising an upper opening, a breech element positioned at an axial end of said upper opening;

ii) a trigger group at least partially housed in the receiver comprising a trigger, a hammer device operable by the trigger and a safety member positionable in a shooting position, in which the safety member is disengaged from the hammer device and in a safety position, in which the safety member engages the hammer device, blocking the hammer device;

iii) a carriage assembly comprising a shutter group, positioned on the receiver at the upper opening and movable by a user axially between an advanced shooting configuration, in which the shutter group engages the breech element and a retracted rearming configuration, in which the upper opening is open, and vice versa, wherein the carriage assembly further comprises a safety group controllable by the user, with the carriage assembly in the advanced configuration, in a ready-to-shoot configuration, in which the safety group is disengaged from the safety member, and a safety configuration, in which the safety group engages and keeps the safety member in the safety position;

wherein the safety group comprises a safety button positionable by the user between a shooting position, a safety position, and a blocking position.

* * * * *